US005864931A

United States Patent [19]

Best et al.

[11] Patent Number: 5,864,931

[45] Date of Patent: Feb. 2, 1999

[54] FELT, IN PARTICULAR A PAPERMAKING-MACHINE FELT, AND METHOD FOR ITS MANUFACTURE

[75] Inventors: Walter Best, Düren; Sylvester Eschmann, Mönchengladbach; Walter Schaaf, Düren, all of Germany

[73] Assignee: Thomas Josef Heimbach GmbH & Co., Germany

[21] Appl. No.: 400,513

[22] Filed: Mar. 7, 1995

Related U.S. Application Data

[60] Continuation of Ser. No. 154,532, Nov. 19, 1993, abandoned, which is a division of Ser. No. 953,191, Sep. 29, 1992, Pat. No. 5,268,076, which is a continuation of Ser. No. 704,354, May 23, 1991, abandoned.

[51] Int. Cl.[6] ..... B32B 5/06

[52] U.S. Cl. ..... 28/110; 139/383 A; 156/148; 162/358.1

[58] Field of Search ..... 28/107, 108, 110; 162/358.1; 139/383 A; 156/148, 137

[56] References Cited

U.S. PATENT DOCUMENTS

| | | | |
|---|---|---|---|
| 3,097,413 | 7/1963 | Draper | 28/110 |
| 3,673,024 | 6/1972 | Eriksson | 28/110 |
| 4,594,756 | 6/1986 | Beck | 28/110 |
| 4,614,969 | 9/1986 | Gerundt et al. | 28/110 |
| 4,701,986 | 10/1987 | Günther et al. | 28/110 |

FOREIGN PATENT DOCUMENTS 645118 7/1962 Canada .

*Primary Examiner*—James J. Bell
*Attorney, Agent, or Firm*—Joseph W. Berenato, III

[57] ABSTRACT

A felt, especially for the press part of a papermaking machine, comprises at least one support belt and at least one fiber belt deposited on and affixed to it. In order to impart to such a felt improved operational properties while retaining adequate transverse stability and in order to manufacture it at substantially lower cost, the support belt(s) 45, 50, 57, 58, 64, 71, 72 each are composed of at least one support-belt strip 46, 51, 52, 59, 60, 65, 66, 73, 74, 75 with a width less than that of the support belt(s) 45, 50, 57, 58, 64, 71, 72 , said strip(s) being continuously wound essentially in the direction of advance of the felt 42, 47, 53, 61, 67 and also spirally transverse to it. Basically manufacture is carried out by means of the following method steps:

a) first a belt of material is manufactured, b) at least one support-belt strip 46, 51, 52, 59, 60, 65, 66, 73, 74, 75 is affixed to the belt of material and evinces a width less than that of the finished felt 42, 47, 53, 61, 67, c) the belt of material is displaced in the direction of advance, d) the first support belt 45, 50, 57, 58, 64, 71, 72, and where called for other support belts 45, 50, 57, 58, 64, 71, 72, is constructed by means of a relative motion between the particular support-belt strip 46, 51, 52, 59, 60, 65, 66, 73, 74, 75 and the already built-up part 41 of the felt 42, 47, 53, 61, 67 spirally and transversely to the direction of advance of the belt of material, e) each support belt 45, 50, 57, 58, 64, 71, 72 is connected to at least one fiber belt 43, 44, 48, 49, 54, 55, 56, 57, 62, 63, 68, 69, 79.

21 Claims, 2 Drawing Sheets

FELT, IN PARTICULAR A PAPERMAKING-MACHINE FELT, AND METHOD FOR ITS MANUFACTURE

This is a continuation of application Ser. No. 08/154,532, filed on Nov. 19, 1993, abandoned, which is a division of application Ser. No. 07/953,191 filed Sep. 29, 1992, U.S. Pat. No. 5,268,076 which is a continuation of application Ser. No. 07/704,354 filed on May 23, 1991, abandoned.

DESCRIPTION

The invention concerns a felt, in particular a papermaking-machine felt, especially for the press-part of a papermaking machine, with at least one support belt and at least one fiber belt deposited on and joined to it. The invention further concerns a method for manufacturing such an endless felt. Such felts are used foremost to move thin webs through equipment manufacturing them, a major field of application being the making of paper in papermaking machinery.

The known felts comprise at least one support belt and at least one fiber belt deposited thereon. The support belt—there may also be several superposed support belts with sandwiched fiber belts—is designed in such a way that it provides the longitudinal and transverse structural strength to the felt that it needs for the anticipated purpose. Accordingly these are cohesive belts, preferably woven structures being used. However knits, spun-fiber webs of transverse and longitudinally reinforced composite structures of sheets of unwoven filaments also have been proposed.

Thereupon a fiber belt is deposited at least on the surface of the support belt to which it shall be connected in order to achieve a smooth surface and to avert damage to the strip to be moved, for instance a web of paper. In the press part of the papermaking machine, the design of such a felt moreover is matched to achieving as good as possible a dehydration through the felt.

Conventionally, the felts are manufactured mainly in such a way that first the support belt is made with a width corresponding to that of the finished felt and in that only then shall a full-width fiber belt be deposited on, and connected to the support belt. This connection preferably is in the form of needling, though bonding also may be used.

Methods and equipment are known for manufacturing endless felts, also called tube-felts, whereby first a support belt is made in width corresponding to that of the finished felt and then is pulled over two spaced rollers and stretched between them. Next a strip of fiber belt of a lesser width than that of the finished felt is mounted to the support belt. Thereupon the support belt is moved in the direction of advance, a relative motion between the strip of fiber belt being advanced on one hand and the support belt on the other, transverse to said direction of advance being also produced. On account of this relative motion the strip of fiber belt progressively is wound onto the support belt transversely to the direction of advance. Gradually a fiber belt is built up, which also may be composed of several layers. Simultaneously needling is carried out in this equipment and thereby connection between the fiber belt and the support belt.

Two different designs are known to generate the relative motion. In the equipment of the German patent documents B 23 24 985; A 39 37 651 and A 39 37 652, the feed device of the strips of fiber belt are displaced transversely to the advance rollers. The process is kinematically the reverse for the equipment of the German patent document B 1 660 765 and European patent document B 0 123 969. In the latter case, the feed device is stationary and accordingly it is the support belt which is transversely displaced on the advance rollers. For that purpose the advance rollers comprise grooves parallel to their longitudinal axes within which move drive chains comprising needles entering the support belt. Conceivably, though it would be expensive, both principles may be combined.

Moreover the European patent document B 0 123 969 does point out that this equipment also may be used for such treatment and processing as singeing, needling, brushing or the like. Again filaments spaced apart may be deposited on the felt to form dehydration channels.

In addition it is known from the U.S. Pat. No. 3,097,413 to make an endless tube felt by first preparing an sheet of unwoven filaments of one or more filaments spaced apart and coiling around the rollers, whereupon a fiber belt is fed with a width corresponding to the finished felt's width, said felt having been previously made by cross-cutting a strip of felt belt and then being needled into the support belt. It is possible in this manufacture also to feed together with the transversely supplied strip of felt belt an sheet of unwoven filaments parallel thereto and a distance away which then extend in the finished felt transversely to its direction of advance. The U.S. Pat. Nos. 4,495,680 and 4,594,756 relate to equipment for making the sheet of unwoven longitudinal filaments known from U.S. Pat. No. 3,097,413, the longitudinal sheet of unwoven filaments thereupon being amenable to being needled to a fiber belt, in the equipment itself or in a conventional needling machine.

The object of felts of such designs was to avert crossing points characteristic of woven materials but instead to achieve only sheets of unwoven longitudinal filaments. However this had to be achieved at the cost of making a complete sheet of unwoven filaments, with accessory steps required to stabilize the sheet of unwoven filaments for the ensuing needling. For that purpose either detachable foils were bonded onto the sheet of unwoven filaments, or the sheet of unwoven filaments was made with detachable cross filaments which following needling were removed. The fiber belts too were initially made in the final width of the felt before being needled into the sheet of unwoven filaments. Accordingly the final width is restricted by the equipment width. Besides, the transverse stability of such felts frequently is inadequate in view of the high stresses, especially in the press part of a papermaking machine.

Accordingly felts of the species still are being made with support belts in the form of cohesive transverse and longitudinal bands, even and especially when the fiber-web belt is continuously deposited in the form of fiber-web belt strips in the direction of advance however in spiral manner in the transverse direction. This is shown by the recently published German patent documents A 39 37 651 and A 39 37 652. This entails the drawback that first the support belt must be manufactured with the width corresponding to that of the finished felt, and this is carried out in correspondingly wide machinery, for instance weaving or knitting machines. Because papermaking machine felts in particular are quite wide, expensive and mostly slow weaving machines must be used. Knitting machines anyway are available only in restricted widths, and accordingly knitted materials so far have been used only for narrow felts. Moreover the machines must be set up individually for each papermaking machine felt because these felts are not mass-produced. High costs of production and low flexibility ensue. Moreover moving such felts inside the plant and installing them in equipment receiving the fiber belt is complex and costly.

Another drawback of the felts of this species is that their structure is transversely continuous. As a result, discontinuities such as seams or the like stretch across the entire felt width. Such felts are very susceptible to vibrations and entail corresponding problems in the particular machine.

The object of the invention is to so design a papermaking-machine felt of the initially cited kind that while evincing adequate transverse stability, it shall offer improved operational properties and can be manufactured at substantially lower costs.

This problem is solved by the invention in that the support belt(s) each consist of at least one support-belt strip with a width less than that of the support belt(s) and essentially progressively winding in the direction of advance of the felt and transversely coiling in relation to said direction. Basically the manufacture is implemented by the following method steps:

a) first a length of material is prepared, b) at least one strip of support belt is affixed to this length of material and with a width less than that of the finished felt, c) the length of material is displaced in the direction of advance, d) the build-up of the first support belt and where called for of further support belts is implemented by means of a relative motion between the particular support-belt strips and the already built-up part of the felt transversely to the direction of advance of the length of material and in a spiral manner, e) each support belt is connected with at least one fiber belt.

Thereby the invention for the first time creates a felt of which the particular support belt is composed of one or more support-belt strips extending essentially in the direction of advance of the felt but being wound in spiral manner. Surprisingly it was found that such a support belt—compared with sheets of unwoven filaments—provides adequate transverse stability. Manifestly this is related to the support-belt strips inherently being transversely stable and therefore being free of the tendency to escape or shift transversely. Moreover the transverse stability is effectively increased in that the fiber belt is connected surface-wise with the strips of support belts, especially by needling. Accordingly the felt may be used also in the presence of high stresses such as occur foremost in the press part of a papermaking machine without thereby incurring dimensional degradation as compared with the felts of the species.

Moreover the felt and in particular its manufacturing method offer appreciable advantages. Because of the winding process, any problem sites in the strip of support belt are restricted to its width and will not extend to the whole felt width. As a result the generation of vibrations is much reduced and even eliminated. This makes it possible too to provide a sequence of support-belt strips with different properties because then the ensuing problem sites are localized to the width of the particular support-belt strip. As a result many variations are possible in designing the support belt. Illustratively one may vary the permeability across the felt width in response to requirements. Again the chemical outfitting may be made to differ in order to produce special properties at required, particular sites.

Besides the substantially improved properties and the possibility of variations relating to the felt, there are also substantial advantages when manufacturing this felt. Independently of the width of the finished felt, a weaving or knitting machine of correspondingly slight width suffices in the manufacture of the strip of support belt. Such machines both are economical and more rapid. Moreover for the first time it is possible to make very wide felts, such as are used in high-output papermaking machines, with a support belt in one knitting. The support-belt strips may be produced in great lengths and therefore without machine change-over on feed rolls, whereby manufacture again is more economical and more flexible. Similar conditions of course also apply to the manufacture of support-belt strips made from foils, spun-fiber webs or compound sheets of unwoven filaments.

As regards the manufacture proper of the felt, the supply rolls are correspondingly called on and thereupon are fed to equipment known in principle from the initially cited documents (German patent documents A 23 24 985; A 39 37 652 and B 1 660 765; European patent document B 0 123 969). The manufacture of the felt composed of support belt and fiber belt can be carried out in this equipment in one operational step, whereby again the production costs are appreciably lower than for conventional felts. Practically no limits are set on the felt width, that is, very wide felts can be made regardless of the width and structure of the particular support-belt strip. Moreover no particular steps are required to adjust such width because manufacture merely stops when the final width of the felt has been reached.

The invention provides that the support belt, or at least one support belt be composed of several layers of superposed support-belt strips. This makes it possible to impart different properties to the individual layers of the support belt by utilizing corresponding support-belt strips. If this is not required, the support belt, or at least one support belt, may be formed by a support-belt strip which is wound in several superposed layers.

The support-belt strip or at least one support-belt strip may be wound in spiral form in such manner that the particular support-belt strips adjoin each other. The result is an especially uniform support-belt structure across the width of the felt. As an alternative, the adjoining coil segments of the particular support-belt strip also may partly overlap. Especially good stability is achieved thereby, in particular when the overlapping segments are needled to the fiber belt.

As regards multi-layer support belts, at least one layer with overlapping support-belt strips and one layer with non-overlapping ones may be combined preferably in such a way that the longitudinal edges of the support-belt strips shall not be one above the other, ie, they shall be mutually offset.

The felt of the invention may be built up in arbitrary manner. Illustratively several support belts separated by one fiber belt may be provided. The felt furthermore may comprise a fiber belt on both sides, and it may comprise also fiber belts built up in several layers.

In another feature of the invention, the fiber belt or at least one fiber belt is composed of at least one fiber-belt strip of which the width is lesser than that of the felt, said fiber-belt strip(s) being continuously wound in the direction of advance of the felt and spiraling transversely to this direction. Accordingly in the invention the fiber belt—or where several fiber belts are concerned, at least one and possibly all—shall be built up in the same way as the support belt. The fiber belt construction offers several advantages. On one hand the fiber-belt strip can be manufactured on a small machine of corresponding width and can be kept ready in the form of supply rolls. On the other hand the ensuing felt manufacture—once all fiber belts have been correspondingly built up—can take place in a machine and therefore especially economically.

Appropriately the fiber-belt strip, or at least one of them, from which is constructed a fiber belt adjoining a support belt, shall be wound as a spiral in such manner that the fiber-belt strip is connected each time with two adjacent turn segments of the support-belt strip. This arrangement reinforces the transverse stability of the felt. Where especially high requirements are placed on felt surface quality, appropriately at least one side of the fiber belt forming a side of the felt is continuous, that is, it is not built up from a fiber-belt strip.

The method of the invention already sketched in principle above presumes the manufacture of a belt of material for the construction of the support belt, with the support-belt strip being affixed to said belt of material which can be moved in the direction of advance. This belt of material may be different depending on the desired felt construction. Illustratively first a fiber belt may be made separately as wide as the finished felt, for instance on a needling machine and this fiber belt then shall be pulled over the basically known machine to rotate it in the direction of advance. Thereupon the first support-belt strip can be affixed to this fiber belt. However it is possible too to manufacture the length of material as a belt-strip of a width less than that of the finished felt and to remove the strip of belt material at the latest when the felt is finished. The support-belt strip or several can be affixed at the beginning of the support-belt construction to said strip of belt material. The strip of belt material illustratively may be a waste or reject material of arbitrary structure.

As an alternative however the belt of material may be built-up in combined manner, namely from a strip of material belt of lesser width than that of the finished felt and from at least one fiber-belt strip affixed thereto of which the width(s) shall be also less than that of the finished felt. In the process the strip(s) of fiber belt are built up as a spiral into a fiber belt by being introduced continuously and with relative motion transversely to the direction of advance between strip(s) of fiber belt and the already built-up part of the fiber belt. In this case the belt of material therefore consists of strip of belt material which shall be removed following manufacture and further of a strip of fiber belt which is being built up by spirally winding it into a fiber belt. The support-belt strip is then affixed to said fiber belt in order to build up the support belt, such fastening taking place simultaneously with or directly after the connection of the fiber-belt strip to the strip of material-belt, or only after the fiber belt has been made. Following removal of the material-belt strip, a felt consisting of a support belt and an external fiber belt is then obtained.

As already mentioned, there is the possibility already to provide further fiber belts built-up from fiber-belt strips in the manner described above in order to carry out the manufacture in a machine. Where the fiber-belt strips and the support-belt strips are introduced adjoining each other, they should be supplied offset transversely to the direction of advance in such manner that each time the fiber-belt strip shall be located above two adjoining support-belt strips. As a result the felt transverse stability shall be reinforced. The supply also may be carried out in such a way that each time one multi-layer support belt and/or one multi-layer fiber belt are being built up, either by introducing several support-belt strips and/or fiber-belt strips, or by one support-belt strip or fiber-belt strip shall be wound in superposed manner transversely to the direction of advance by means of at least a single reversal of the relative motion between the support-belt strip or the fiber-belt strip and the already built-up part of the felt.

Moreover the supply of support-belt strips and/or fiber-belt strips may be such that the longitudinal edges always shall be adjoining or that the turn segments shall partly overlap. As regards multi-layer fiber-web belts and/or support belts, these two alternatives also may combined with each other by layers.

Obviously it is also possible when in the presence of corresponding requirements that additionally at least one additional fiber belt be separately manufactured in the width of the finished belt and that then it shall be deposited on and affixed to the top and/or the bottom side of the built-up part of the felt. Again several support belts may be built up by winding support-belt strips in spiral manner, a fiber belt being constructed each time between the support belts by winding fiber-belt strips in spiral manner.

Especially effective connection of fiber belt to support belt and hardly affecting the felt structure can be carried out in known manner by needling, which may take place stripwise or already during the construction of the support belt and/or fiber belt by providing the implementing equipment with a corresponding needling device.

The invention is elucidated in the drawing by means of illustrative embodiments.

Figure 1:
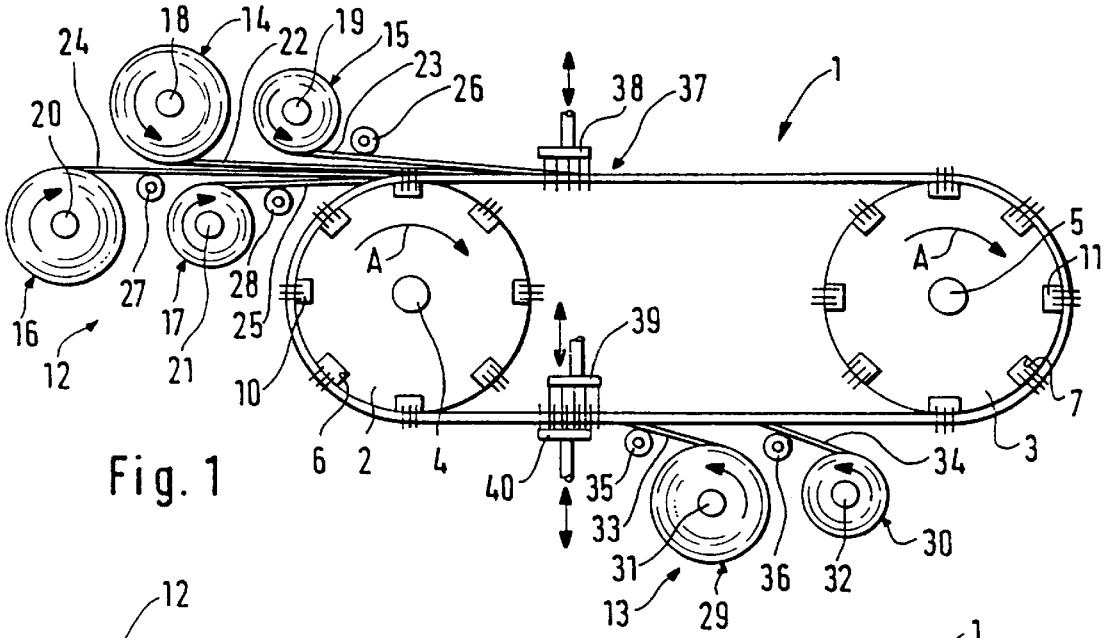
FIG. 1 is a schematic sideview.
Figure 2:
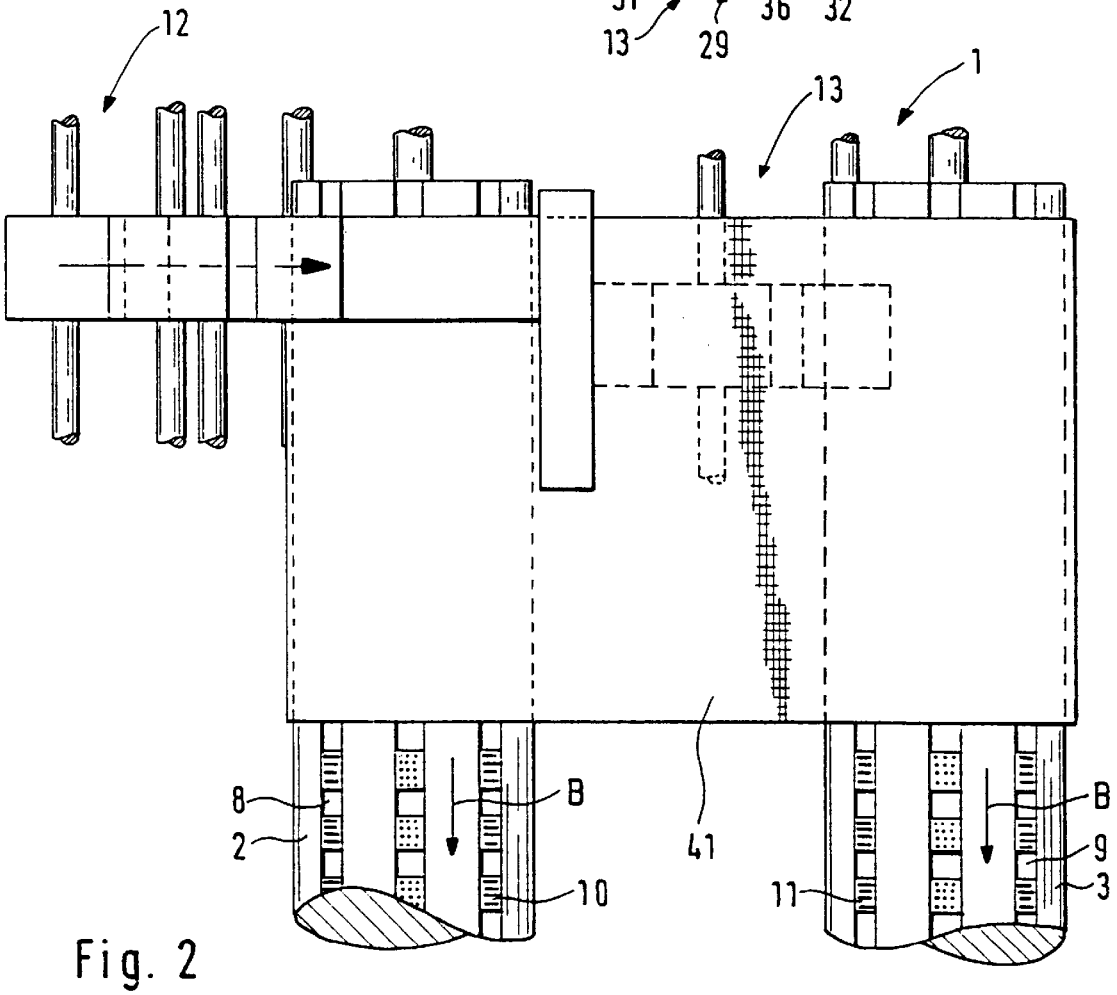
FIG. 2 is a topview of equipment for making a felt.

The equipment 1 shown in FIGS. 1 and 2 comprises two advance rollers 2, 3 rotating on horizontal shafts 4, 5 and horizontally apart. The advance rollers 2, 3 comprise grooves illustratively denoted by 6, 7 parallel to the shafts 4, 5 and distributed over the surfaces, which guide the drive chains illustratively denoted by 8, 9. These drive chains bear needle elements illustratively denoted by 10, 11 projecting above the surfaces of the advance rollers 2, 3. The advance rollers 2, 3 rotate in the directions of arrows A.

The equipment 1 comprises two feed or supply devices 12, 13. A total of four supply rolls 14, 15, 16, 17 are supported in the upper feed device 12 so as to be rotatable in the direction of the shown arrows, namely two adjacent upper supply rolls 14, 15 and again two adjacent lower supply rolls 16, 17. Each supply roll 14, 15, 16, 17 comprises one pivot shank 18, 19, 20, 21 each receiving a wound belt strip 22, 23, 24, 25. Guide rollers 26, 27, 28 assure problem-free guidance of the unwound belt strip 22, 23, 24, 25.

A carding device feeding a fiber web may be provided in addition to the supply rolls 14, 15, 16, 17.

The second supply means 13 is mounted at the lower side of the equipment. It comprises two adjacent supply or feed rolls 29, 30 consisting here too of the pivot shanks 31, 32 and the belt strips 33, 34 mounted on them. Guide rollers 35, 36 serve to support the unwound belt strips 33, 34.

The equipment 1 further includes a needling machine 37 of which merely the needle bars 38, 39, 40 are shown here. The needle bars 38, 39, 40 are mounted one above the other and are vertically displaceable. A needle bar 38 is present in the upper part of equipment 1, whereas the lower part comprises two needle bars 39, 40 moving in opposite directions.

Depending on the desired construction of the felt being made by the equipment 1, fiber-belt strips or support-belt strips may be used as the belt strips 22, 23, 24, 25, 33, 34. The fiber-belt strips then consist of a fiber web which may evince different fiber orientations, finenesses and fiber densities, whereas the support-belt strips may evince different structures, for instance being woven, knit, spun-fiber web, foil and or strips of composite sheets of unwoven filaments.

At the beginning of manufacturing, first a strip of belt-material is pulled onto the two advance rollers 2, 3 up to about the feed-level of the supply rolls 14, 15, 16, 17, 29, 30. This strip of belt material illustratively may be a strip of woven reject. Thereupon the individual belt strips 22, 23, 24, 25, 33, 34 are mounted by their butt ends to this strip of belt material. Next the two advance rollers 2, 3 and thereby the strip of belt material are displaced in the direction of advance whereby the belt strips 22, 23, 24, 25, 33, 34 are taken off the supply rolls 14, 15, 16, 17, 29, 30 and come to rest on the strip of belt material. Simultaneously the needling machine 37 is actuated so that the individual belt strips 22, 23, 24, 25, 33, 34 are needled together, that is, the fibers of the fiber-belt strips penetrate the support-belt strips.

On account of the rotation of the advance rollers 2, 3 the drive chains 8, 9 also are set in motion in the directions of the arrows B. Consequently the strip of belt-material and thereby also that part 41 of the belt already built up on it are moved along. Because of the relative motion between this felt part 41 and the belt strips 22, 23, 24, 25, 33, 34, the latter are spirally wound on the advance rollers 2, 3 at a pitch corresponding to the speed of the drive chains 8, 9.

The process continues until the felt has attained its final width. The belt strips 22, 23, 24, 25, 33, 34 then are cut off. The finished felt is taken off the advance rollers 2, 3 by again operating the drive chains 8, 9. Following the removal of the felt, the strip of belt material that was used in merely accessory manner is separated. Thereupon the felt either is finished or may be used for further processing, for instance in order to needle, in a suitable machine, a further fiber belt which already initially evinced the felt width.

Obviously variations of the shown equipment 1 are conceivable. Illustratively the individual supply rolls 14, 15, 16, 17, 29, 30 also may be mutually offset so that the belt strips 22, 23, 24, 25, 33, 34 shall be fed at a corresponding offset, with especial advantages for transverse stability. Again not all supply rolls 14, 15, 16, 17, 29, 30 need be present. Moreover the distance between the advance rollers 2, 3 is adjustable so that felts of different lengths also can be made.

Figure 3:
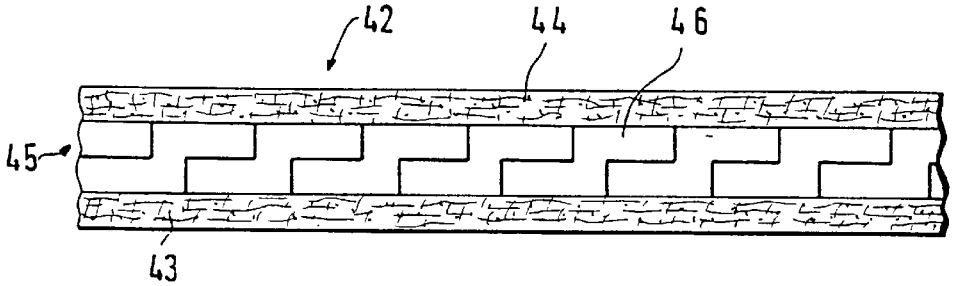
FIGS. 3 through 7 are various, schematic embodiments of felts.

FIGS. 3 through 7 show various embodiment modes of felts made on equipment 1, the views being transverse to the direction of advance. In the embodiment of FIG. 3, the felt 42 comprises a lower fiber belt 43 and an upper fiber belt 44, a support belt 45 being mounted between the two fiber belts 43, 44. The lower fiber belt 44 was made in conventional manner, that is, separately and in the anticipated final width of the felt 42, thereupon being needled in a needle machine to the lower side of the combination of fiber belt 44 and support belt 45.

The fiber belt 44 and the support belt 45 were manufactured in the equipment 1 of FIGS. 1 and 2. The speed of the drive chains 8, 9 was set so low that the individual turns of the support-belt strip 46 partly overlap as schematically shown by the Z-representation of the support-belt strip 46. The upper fiber belt 44 is built up in corresponding spiral manner. Needling imparts an extensively homogeneous structure to this fiber belt 44. Because of the needling both of the upper and lower fiber belts 43, 44 to the support belt 45, the individual turns of the support-belt strip 46 cannot shift relative to each other. As a result and on account of the stability proper of the support-belt strip 46 in the transverse direction the felt 42 is endowed with adequate transverse stability.

Figure 4:
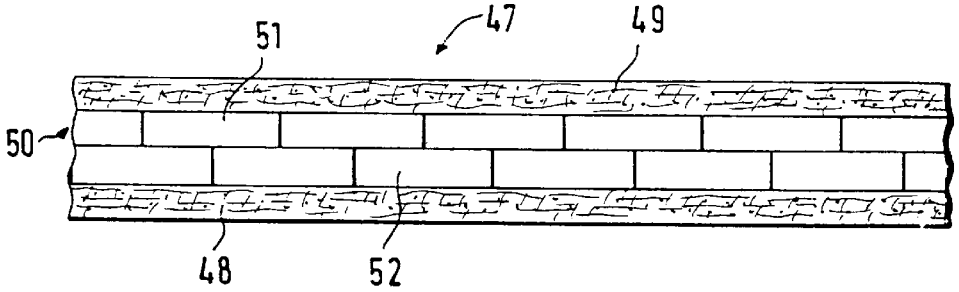

The felt 47 shown in FIG. 4 also comprises a lower and upper fiber belt 48, 49 corresponding to the fiber belts 43, 44 of the felt 42. The sandwiched support belt 50 is composed of two layers by supplying two support-belt strips 51, 52 one above the other in simultaneous or sequential manner. The speed of the drive chains 8, 9 was set high enough that the individual turns of the support-belt strips 51, 52 do not overlap in this case, rather their longitudinal edges butt against each other. Moreover the support-belt strips 51, 52 are supplied in such manner as to be mutually offset, that is, the longitudinal edges of the turns of the lower support-belt strip 52 are offset relative to those of the upper support-belt strip 51. By needling the fiber belts 48, 49 to the support belt 50, adequate transverse stability is achieved in this case too.

Figure 5:
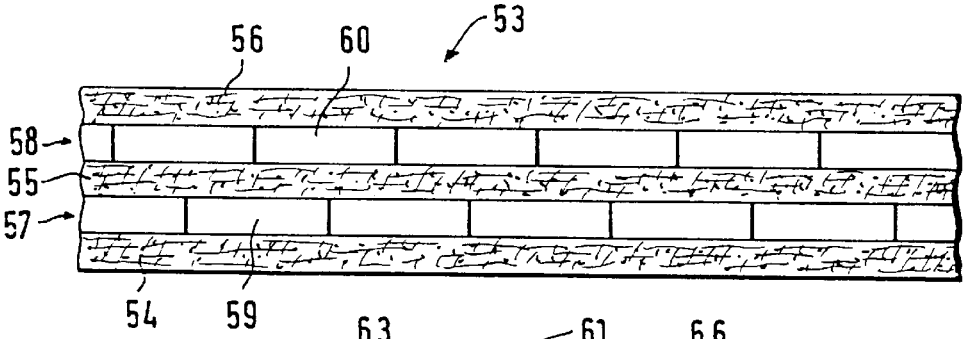

The felt 53 shown in FIG. 5 comprises three superposed fiber belts 54, 55, 56 with a support belt sandwiched between them each time. The lower fiber belt 54 was made and needled conventionally in the manner of the lower fiber belts 43, 48 of the felts 42, 47. The central and upper fiber belts 55, 56 were built up in the equipment 1 of FIGS. 1 and 2 by the spiral deposition of a fiber-belt strip. The same applies also to the support belts 57, 58 built up from support-belt strips 59, 60 by having been fed to the equipment 1 of FIGS. 1 and 2. This took place each time in such a way that the turns of the support-belt strips 59, 60 are abutting. The support-belt strips 59, 60 were fed-in offset relative to each other so that the longitudinal edges are not located one above the other. The individual layers of the felt 53 were connected by needling the fiber belts 54, 55, 56 to the support belts 57, 58.

Figure 6:
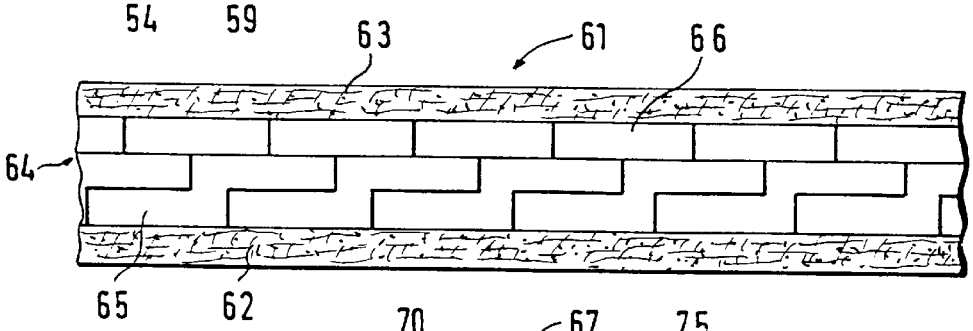

The felt 61 shown in FIG. 6 comprises a lower fiber belt 62 and an upper fiber belt 63. The lower fiber belt 62 was needled subsequently following separate manufacture, whereas the upper fiber belt 63 was built up in the equipment 1 of FIGS. 1 and 2 by spirally winding a fiber-belt strip. A support belt is enclosed between the two fiber belts 62, 63 and is composed of two layers. The lower layer of the support belt 64 is formed by a support-belt strip 65 wound in the same manner as the support-belt 46. Accordingly the individual turns of the support-belt strip 65 are overlapping. The upper layer of the support belt 64 on the other hand is composed of a support-belt strip 66 of which the individual turns adjoin each other, that is they are abutting and do not overlap. Both support-belt strips 65, 66 are mutually so offset that their longitudinal edges are not one above the other.

Figure 7:
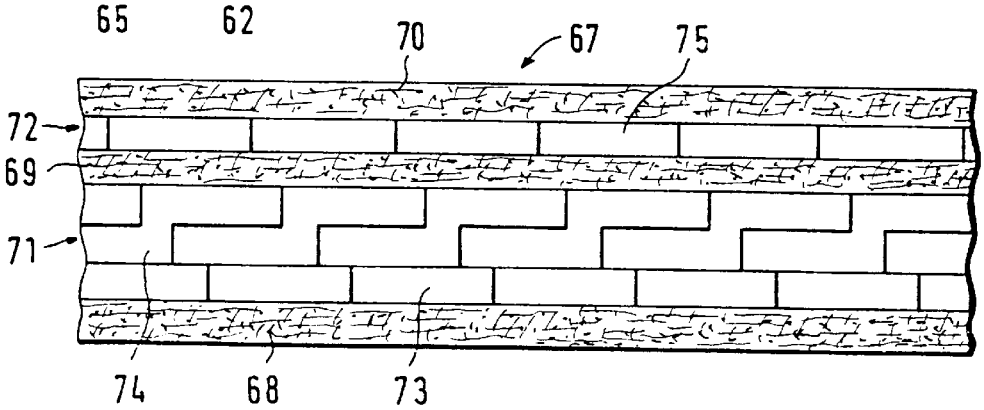

The felt 67 shown in FIG. 7 comprises a lower fiber belt 68, a middle fiber belt 69 and an upper fiber belt 70. The lower fiber belt 68 was made conventionally and separately and then was needled to the others. The above part of the felt 67 was built up in the equipment 1 as shown in FIGS. 1 and 2.

Each time a support belt 71, 72 is sandwiched between the fiber belts 68, 69, 70. The lower support belt 71 is composed of two support-belt strips 73, 74, the turns of the lower support-belt strip 73 being abutting whereas the turns of the upper support-belt strip 74 are overlapping. The upper support belt 72 is so built up from a support-belt strip 75 that its turns are adjoining without overlap. The connection between the individual layers is accomplished by needling the fiber belts 68, 69, 70.

Obviously felts of different designs also may be made with the equipment 1 of FIGS. 1 and 2. Illustratively the particular lower fiber belt can be built up in the equipment 1 from one or more fiber-belt strips. However a plurality of support belts with overlapping turns may be superposed too. In particular when the felt is being manufactured in the equipment 1 of FIGS. 1 and 2, no practical limits are set on the width, that is, not even on extreme widths for which the heretofore available wide apparatus for making the support belt(s) and fiber belts cannot be used, in particular when the support belt(s) are in the form of woven or knit materials.

We claim:

1. A method of manufacturing an endless papermaking felt, comprising the steps of:

a) providing a support belt strip formed from a material cohesive in its longitudinal and transverse directions, the strip having a width less than the width of the felt when finished;

b) forming a support belt by spirally winding the strip so that a first lateral edge thereof is adjoined to a second lateral edge thereof;

c) overlying a fiber belt onto the support belt; and d) forming the felt by operably interconnecting the support and fiber belts.

2. The method of claim 1, including the step of:

a) spirally winding the strip so that the first lateral edge overlaps the second lateral edge.

3. The method of claim 1, including the step of:

a) spirally winding the strip so that the first lateral edge abuts the second lateral edge.

4. The method of claim 1, including the step of:

a) providing the support belt strip from a material which is one of knitted, woven, and spun-fiber web.

5. The method of claim 4, including the step of:

a) providing the support belt strip from a material which is one of knitted and woven.

6. The method of claim 1, including the step of:

a) operably interconnecting the support and fiber belts by needling.

7. The method of claim 1, including the steps of:

a) overlying the support belt onto a second fiber belt; and b) operably interconnecting the support belt to the second fiber belt.

8. A method of manufacturing an endless belt structure, comprising the steps of:

a) providing a support belt length formed from a material cohesive in its longitudinal and transverse directions, the length having a width less than the finished width of the belt structure;

b) forming a support belt adapted to withstand the longitudinal and transverse forces to which the structure is to be put by progressively winding the length in the direction of advance of the structure and transverse thereto, so that at least two layers of strips are thereby provided and a strip of one layer is superposed to a cooperating strip of the other layer;

c) overlying another belt onto the support belt; and d) forming the belt structure by operably interconnecting the support and another belt.

9. The method of claim 8, including the step of:

a) progressively winding the support belt length so that a strip of one layer overlaps a cooperating strip of the other layer.

10. The method of claim 8, including the step of:

a) progressively winding the support belt length so that the strips of one layer abut.

11. The method of claim 8, including the step of:

a) providing a fiber belt as the another belt.

12. The method of claim 8, including the step of:

a) operably interconnecting the support and another belt by needling.

13. The method of claim 11, including the steps of:

a) providing a second fiber belt; and b) positioning the second fiber belt between the layers of the support belt.

14. The method of claim 8, including the step of:

a) providing a support belt formed from a material which is one of knitted and woven.

15. A method of manufacturing a support belt, comprising the steps of:

a) providing a support belt length formed from a material cohesive in its longitudinal and transverse directions, the length having a width less that the finished width of the belt; and b) progressively winding the length in the direction of advance of the belt and transverse thereto so that at least two layers of strips are formed, and a strip of one layer is superposed to a cooperating strip of the other layer.

16. The method of claim 15, including the step of:

a) progressively winding the length so that the strip of one layer overlaps a cooperating strip of the other layer.

17. The method of claim 15, including the step of:

a) progressively winding the length so that the strip of one layer overlies a directly adjacent strip of the other layer and so that the overlying strips thereby define the layers.

18. The method of claim 15, including the step of:

a) providing a length formed from a material which is one of woven, knitted, and spun-fiber web.

19. The method of claim 18, including the step of:

a) providing a length formed from a woven or knitted material.

20. The method of claim 15, including the step of:

a) progressively winding the length so that the strips of one layer are in edgewise abutting contact, and the edgewise abutting strips overlie the strips of the other layer.

21. A method of manufacturing a press felt for use in a papermaking machine, said press felt having a base fabric which is made of yarn material and is endless in a machine direction of the press felt, and at least one layer of fiber material arranged on the base fabric, said method comprising the steps of:

a) manufacturing a fabric strip of yarn material, said fabric strip having longitudinal threads in a longitudinal direction of said fabric strip and presenting a width which is smaller than a width of the base fabric;

b) spirally winding said fabric strip of yarn material, to form in the base fabric a layer of fabric of yarn material, the longitudinal threads of the spirally-wound fabric strip of yarn material making an angle with said machine direction of the press felt; and c) fixing said at least one layer of fiber material to the base fabric.

* * * * *